United States Patent [19]

Yokoyama et al.

[11] Patent Number: 4,714,863

[45] Date of Patent: Dec. 22, 1987

[54] VIBRATION DAMPING MEANS FOR THE LINE CATHODES OF AN IMAGE DISPLAY APPARATUS

[75] Inventors: Toshinobu Yokoyama, Hirakata; Sadao Watanabe, Ashiya; Takatsugu Kurata, Ibaraki, all of Japan

[73] Assignee: Matsushita Electric Industrial Co., Ltd., Kadoma, Japan

[21] Appl. No.: 766,003

[22] Filed: Aug. 15, 1985

[30] Foreign Application Priority Data

Aug. 30, 1984 [JP] Japan ..... 59-181324
Sep. 10, 1984 [JP] Japan ..... 59-189015

[51] Int. Cl.[4] ..... H01J 29/70

[52] U.S. Cl. ..... 315/366; 313/422; 313/269

[58] Field of Search ..... 315/366; 313/422, 269

[56] References Cited

U.S. PATENT DOCUMENTS 2,930,918 3/1960 Coffin ..... 313/269
4,167,690 9/1979 Gange ..... 315/366
4,271,377 6/1981 Gange et al. ..... 315/366
4,376,260 3/1983 Russell ..... 315/366
4,408,143 10/1983 Inohara et al. ..... 315/366
4,451,846 5/1984 Iyehara et al. ..... 358/56

FOREIGN PATENT DOCUMENTS 948944 2/1964 United Kingdom ..... 313/269

*Primary Examiner*—Theodore M. Blum
*Assistant Examiner*—David Cain
*Attorney, Agent, or Firm*—Cushman, Darby & Cushman

[57] ABSTRACT

A video image display apparatus comprising line cathodes for emitting electron beams, a phosphor screen having a phosphor layer which emits light at impingement by said electron beams, and a vacuum enclosure containing the above-mentioned components therein, wherein undesirable vibration is prevented by providing damping strings across and lightly touching the line cathodes for reducing the vibration of the line cathodes by their damping effect.

6 Claims, 5 Drawing Figures

VIBRATION DAMPING MEANS FOR THE LINE CATHODES OF AN IMAGE DISPLAY APPARATUS

FIELD OF THE INVENTION AND RELATED ART STATEMENT

1. Field of the Invention

The present invention relates to a video image display apparatus comprising a flat displaying apparatus which uses thermoelectronic emission.

2. Description of the Related Art

In a video image display apparatus for a prior art television set, a cathode-ray tube having more than one electron gun or a single electron gun set in a neck part of a bulky cone-shaped vacuum enclosure has been used for long time. The shortcoming of the conventional cathode ray tube is its large depth in comparison with the size of the screen face, thereby making it impossible to provide a flat and compact television set. Though an EL display apparatus, a plasma display apparatus, and a liquid crystal display apparatus have been developed, these apparatuses are not sufficiently usable because they have problems in brightness, contrast and/or color.

U.S. Pat. No. 4,451,846 (Iyehara et al) discloses a flat display apparatus for displaying a video image of high quality without such problems with brightness, contrast and color. Iyehara et al disclose a flat display apparatus comprising:

a color phosphor screen comprising a first predetermined number of horizontally divided sections each comprising a set of regions of primary color phosphors, an electron beam source for in-turn emitting a second predetermined number of horizontal rows of electron beams, each row having the first predetermined number of electron beams, producing one horizontal line on the color screen, a horizontal deflection means for selective impingments of the electron beams on the regions in turn selected corresponding kinds of primary color phosphors at one time, in turn changing colors of the horizontally divided sections, a vertical deflection means for vertically deflecting the electron beams in such a manner that electron beams of a horizontal row impinges the phosphor screen in one vertically divided segment which is corresponding to the one horizontal row, thereby vertically moving the one horizontal line in the vertically divided segment, an electron beam control means for simultaneous controlling of intensities of respective electron beams responding to color video signal for the selected kind of primary color to produce a line-at-a time displaying of a color video picture, and a flat shaped vacuum enclosure containing the above-mentioned components therein, one end face thereof forming a screen face in which the color phosphor screen is provided.

The flat display apparatus of Iyehara et al., however, has the disadvantage of vibration of the displayed picture or unevenness of brightness because the electron beam sources (i.e., line cathodes), which are supported and stretched, vibrate so as to make resonance with the electronic load for driving. The line cathodes vibrate more the greater the distance is between two supporting means provided at both ends of the line cathode and other supports. The line cathode (which stretches between two supporting means disposed, for example, at a distance of 20 cm, 20 μm–30 μm being the diameter of the line cathode) vibrates at an amplitude of about 20 μm–100 μm because the line cathode resonates with electric current impressed on the line cathode. The line cathodes continue the vibration for a considerable time, because the line cathode is provided in a high vacuum wherein there is no damping effect by air.

SUMMARY OF THE INVENTION

Accordingly, the purpose of the present invention is to provide a display apparatus which enables a video image of high quality to be displayed without vibration of the image or unevenness of brightness.

DESCRIPTION OF THE PREFERRED EMBODIMENTS

Figure 1:
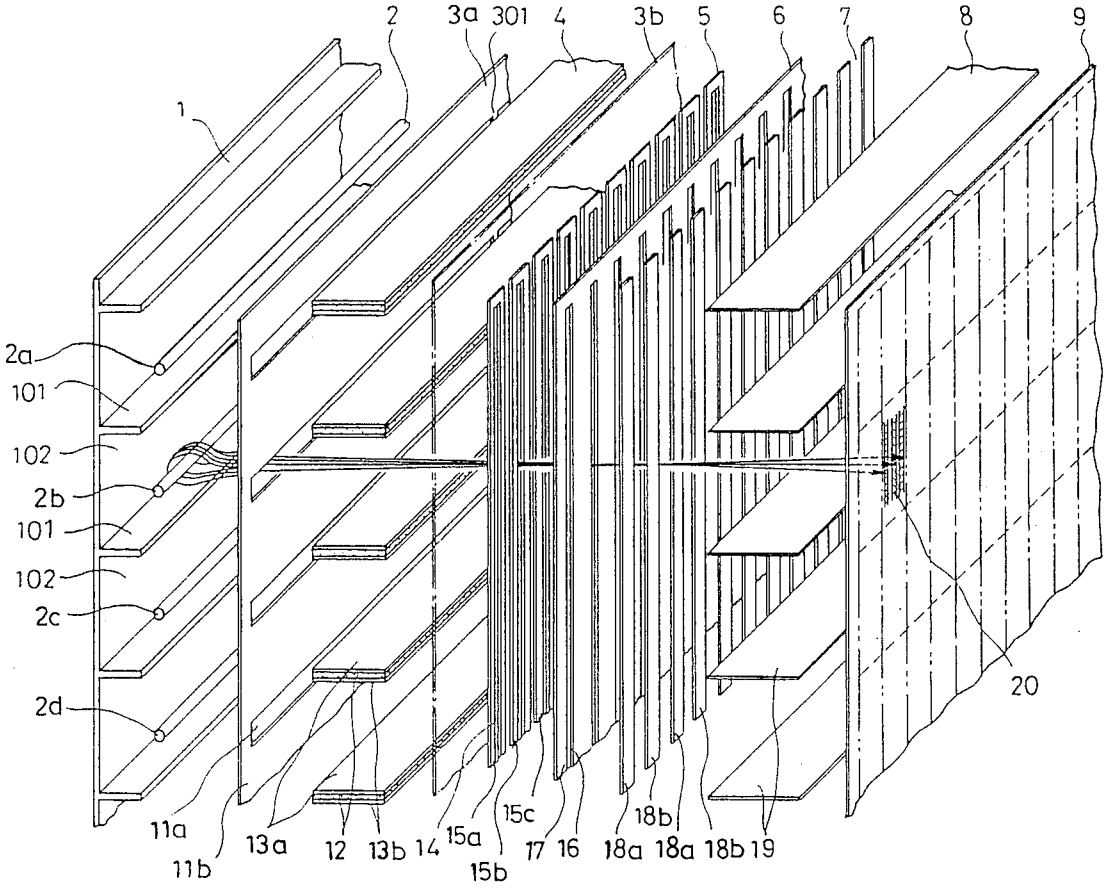
FIG. 1 is an exploded perspective view of a principal part, with its vacuum enclosure removed, of a video image display apparatus of the present invention which has been expanded in the horizontal direction in comparison with the vertical direction for easier drawing of minute constructions.

FIG. 1 shows a fundamental construction of the display apparatus of the present invention. As shown in FIG. 1, from the back part to the front part, the following components are provided in a flat box-shaped evacuated envelope not shown here, but preferably made of glass:

a back electrode 1 having horizontal isolation walls 101 projecting perpendicularly therefrom to form isolated spaces 102 therein;

a row of a predetermined number (e.g. 15 in this embodiment) of horizontal line cathodes 2*a*, 2*b* . . . disposed substantially horizontally in the isolated spaces 102;

a vertical beam-focusing electrode 3*a*, having the predetermined number (e.g. 15 in this embodiment) of horizontal slits 11*a*;

a first vertical deflection means 4 comprising a predetermined number of pairs of vertical deflection electrodes 13*a*, 13*b* . . . , held by insulator board 12;

a second vertical beam-focusing electrode 3*b* substantially similar to the vertical beam-focusing electrode 3*a*;

a predetermined large number (e.g. 320 for this embodiment) of beam control electrodes 5 consisting of vertical strip electrode 15*a*, 15*b*, each having beam-passing slits 14 disposed with uniform pitch;

a horizontal beam-focusing electrode having the predetermined number (e.g. 320 for this embodiment) of vertical slits at positions in front of the slits 14 of the beam control electrodes 5;

a horizontal deflection means 7 comprising the predetermined number (e.g. 320 for this embodiment) of vertical strip electrodes 18*a*, 18*b* defining the predetermined number (e.g. 320 for this embodiment) of vertically oblong deflection gaps inbetween;

a beam acceleration means 8 consisting of a set of horizontally disposed electrodes 19; and finally a phosphor screen 9, which is ordinarily provided on the inner wall of a front face of the enclosure.

The line cathodes 2a, 2b . . . for the electron beam source are disposed forming a vertical row, with substantially uniform gaps between each other. In this embodiment, as above-mentioned, 15 line cathodes 2a, 2b . . . are provided, but only four of them are shown. The line cathodes are made by coating a tungsten wire of, for example, 10–20 μm diameter with known electron emitting cathode oxide. Each of the line cathodes selectively in-turn emit a horizontal sheet-shaped electron beam in a predetermined time.

The back electrode 1 serves to suppress emissions of electrons from other line cathodes (e.g. 2b, 2c, 2d . . . ) with respect to a selected line cathode and also to expel the electrons from the selected cathode toward the phosphor screen 9. The back electrode 1 may be formed by attaching a conductive substance such as conductive paint on the inner wall of the back face of the flat type vacuum enclosure.

The first vertical beam-focusing electrode 3a has the slits 11a facing the line cathodes 2a, 2b . . . and is impressed with a DC voltage so as to form a horizontal sheet-shaped electron beam from the selected line cathode. The sheet-shaped electron beam is then divided into a large number (e.g. 320 in this example) of narrow electron beams by passing the beam through the second vertical beam-focusing electrode 3b, the control electrode 5 and the horizontal focusing electrode 6. In FIG. 1, only one such narrow electron beam is shown for simplicity. Each slit 11a may have ribs provided along its horizontal direction or may consist of a large number (e.g. 320) of openings with very narrow rib parts inbetween.

The electrodes 13a, 13b of the vertical deflection means 4 are disposed at levels substantially equidistant between vertically neighboring horizontal slits 11a of the vertical focusing electrode 3a. A changing voltage (a vertical deflection signal) is impressed across the pair of upper electrodes and lower electrodes thereby forming a changing electric field for vertical deflection.

The beam control electrodes 5 comprise the strip electrodes 15a, 15b, 15c . . . which control intensities of the rod-shaped electron beams responding to the information in the video signal. In this embodiment, the beam control electrodes have 320 strip electrodes; therefore, the 320 strip electrodes control information for 320 picture elements on each horizontal line. The 320 beam control electrodes receive 320 respective control signals and control the 320 rod beams in such a manner that at one time the red color is irradiated, at one time the green color is irradiated, and at one time the blue color is irradiated in turn. In order to display a color picture on the color phosphor screen with the control signals applied to the beam control electrodes, each picture element comprises three elementary color regions, namely a red strip region, a green strip region and a blue strip region, which are disposed in the horizontal direction.

The horizontal beam-focusing electrode 6 is impressed with a DC voltage and focuses the rod-shaped electron beams in the horizontal direction. The horizontal deflection means 7, comprising strip electrodes 18a, 18b which are impressed with a 3-level changing voltage or a horizontal deflection signal, then horizontally deflect the rod-shaped electron beams. The horizontal deflection means 7 makes the rod-shaped electron beams which selectively impinge red phosphor regions, green phosphor regions or blue phosphor regions in turn. In this embodiment, for example, a horizontal row of 320 rod-shaped electron beams impinge 320 sets of three primary color regions, one horizontal deflection range corresponding to one horizontal picture element width.

The beam acceleration means 8 comprises the electrodes 19 which are disposed at the height level corresponding to those of the composite body of vertical deflection electrodes 13a, 13b, and the electrodes 19 are impressed with DC voltage.

The phosphor screen 9 may be provided with a metal back layer formed on the side of the cathodes. The phosphor regions are formed in vertically oblong strips of red color phosphors, green color phosphors and blue color phosphors. In FIG. 1, horizontal broken lines on the phosphor screen 9 show boundary lines between neighboring vertically divided segments to be impinged by electron beams of the respective line cathodes. Vertical chain lines on the phosphor screen 9 show boundary lines between horizontally neighboring sets of three primary color phosphor strips. However, with respect to FIG. 1, it should be noted that the size in the horizontal direction is expanded much more exaggeratedly than that of the vertical direction for color representation.

In this embodiment, for each control electrode 5, that is, for each electron beam, although only one set of phosphors 20 of R, G and B for one picture element is provided, more than two sets of phosphors for more than two picture elements may also be possible. In such a case, R-, G- and B-video signals for more than two picture elements are applied sequentially to the control electrodes 5 in synchronism with the horizontal deflection.

Figure 2:
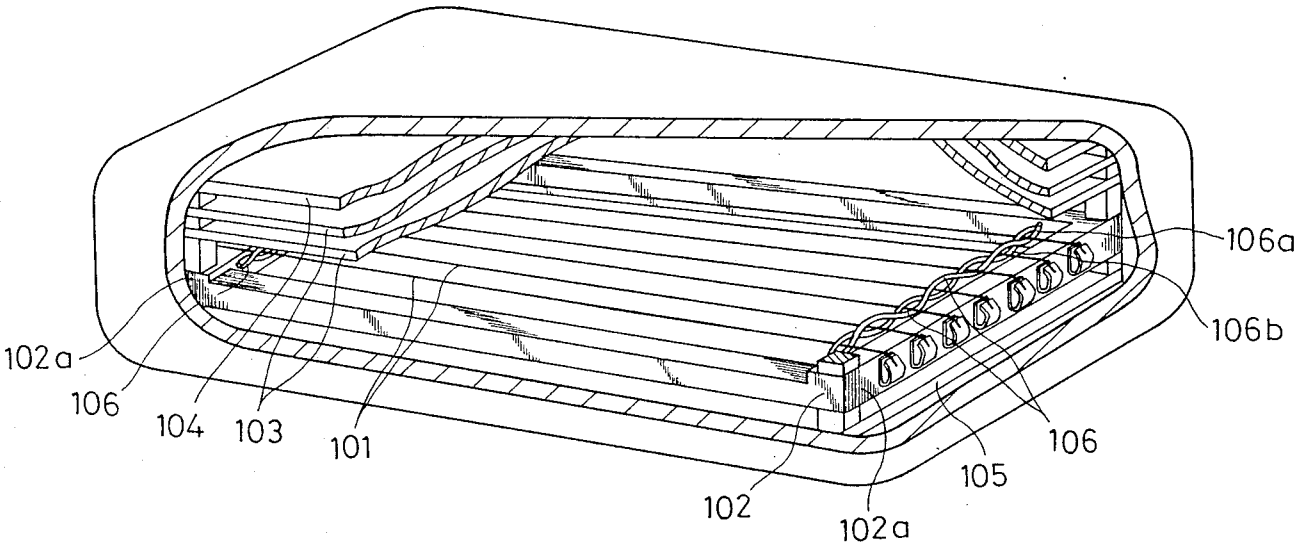
FIG. 2 shows a perspective view of a display apparatus in accordance with an embodiment of the present invention.

FIG. 2 shows a perspective illustration of the embodiment. The line cathodes 101 are held stretched with tension of 20 g between both ends 102a of the supporting means 102 which has a V-shaped groove at its supporting part for the line cathodes 101. Numeral 103 indicates an electron beam controlling means comprising elements such as the vertical beam-focusing electrodes 3a, 3b, the first vertical deflection means, the second vertical beam-focusing electrode and others. Numeral 104 indicates the phosphor screen.

FIG. 2 also shows a vibration damping means 106 which comprises vibration damping strings 106a, 106b which are provided across and lightly touching the line cathodes 101. The damping strings 106a, 106b are made of glass fibers of 50–100 μm diameter and are knitted together with the line cathodes 101. The damping strings 106a, 106b prevent the swinging of the line cathodes 101 because the damping strings 106a, 106b convert vibration energy into a damping energy by friction between the line cathodes 101 and the damping strings 106a, 106b. The damping effect of the damping strings 106a, 106b is as follows.

The forced vibration is expressed below in equation 1 in the case that damping in proportion to the speed exists:

$$\ddot{x}+2n\dot{x}+\omega_0 x=f(t) \quad (1)$$

where x: amplitude of the vibration of line cathode 101;

n: attenuation constant of the damping strings 106a, 106b;

$\omega_0$: eigenfrequency of the line cathode 101; and f(t): external force loaded on the line cathode 101.

The general solution of the equation 1 in the case $\omega_0 > n$ is as follows:

$$x = \frac{x_{st} \cdot \sin(\omega_t - \alpha)}{\sqrt{(1 - P^2/\omega_0^2)^2 + 4n^2P^2/\omega_0^4}} \quad (2)$$

where $x_{st}$: static displacement of the line cathode 101, and $$\tan \alpha = 2nP/(\omega_0^2 - P^2) \quad (3).$$

Next, in a forced vibration, work done by an external force during one cycle of the vibration is considered. Provided that a force of f[sin (pt)] is applied, the fulcrum swings as:

$$x = A \sin(Pt - \alpha)$$

Therefore, work load W in the period of one cycle by the external force is $$W = \int f[\sin(pt)]dx = \pi f A \text{ Sin } \alpha \quad (5)$$

Energy W' consumed for attenuation is expressed:

$$W' = \oint 2npA \cos(pt - \alpha)dx = 2np\pi A^2 \quad (5)$$

As the work load W, is equal to the energy W' the following relation holds:

$$\pi f A \sin \alpha = 2np\pi A^2 \quad (6)$$

$$A = \frac{f \sin}{2np} \cong \frac{f}{2np}$$

As determined by experimentation, the attenuation constant $n_0$ of the line cathode without the damping strings is:

$$n_0 = 0.01 - 0.001[1/\text{sec}]$$

The attenuation constant $n_1$ of the line cathode with the damping strings in accordance with this embodiment is:

$$n_1 = 1 - 0.5[1/\text{sec}].$$

Therefore, the ratio of the amplitudes equals:

$$\frac{A_1}{A_0} = \frac{f/2n_1P}{f/2n_0P} = \frac{n_0}{n_1} = 0.01 - 0.0002 \quad (7)$$

where $A_0$: maximum amplitude in accordance with the prior art; and $A_1$: maximum amplitude in accordance with the present invention (the case of using the damping strings 106a, 106b).

The damping effect by the phase shifting between the line cathode 101 and the damping strings 106a, 106b reduces the shaking of the displayed picture and unevenness of brightness because the damping strings reduce the amplitude of the vibration to less than about 20 μm (in the prior art, about 200 μm) in spite of the vacuum. The image display apparatus in accordance with the invention thus displays a high quality image without distortion, for the damping strings, which are stretched to a light tension, maintain the parallel relationship between the line cathodes.

Figure 3:
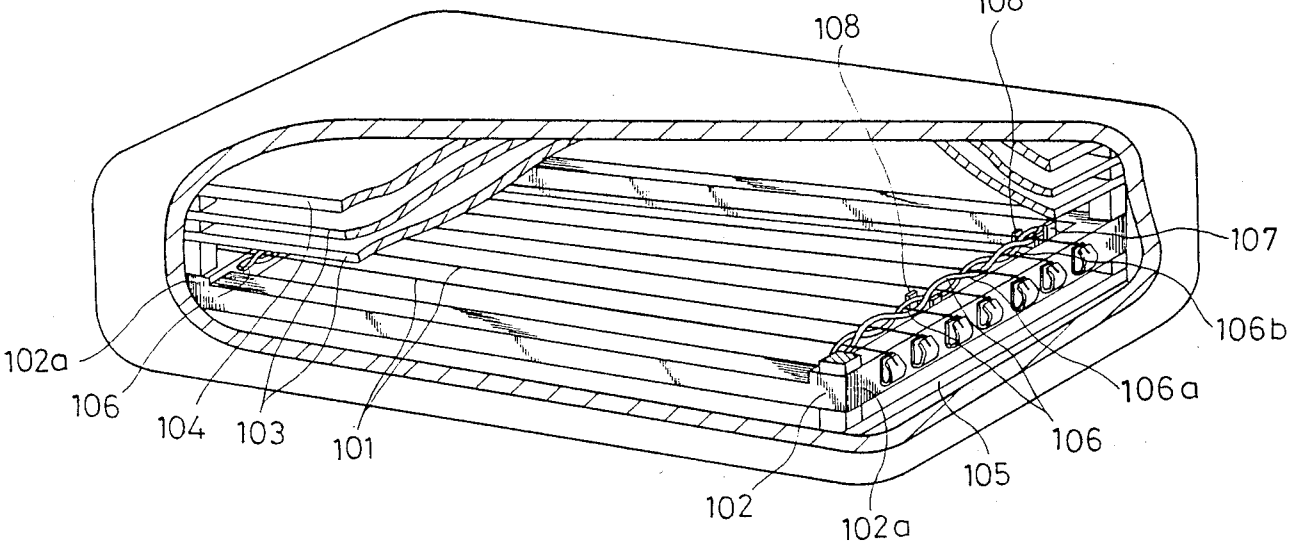
FIG. 3 shows a perspective view of a display apparatus in accordance with another embodiment of the present invention.

FIG. 3 shows the perspective illustration of another embodiment. The corresponding parts to FIG. 2 are designated by the same numerals as FIG. 2. In FIG. 3, numeral 107 designates a fixing member which fixes only one end of the damping strings for increasing the damping effect and for preventing dropping out of the dampening strings 106a, 106b from the line cathode 101.

Figure 4:
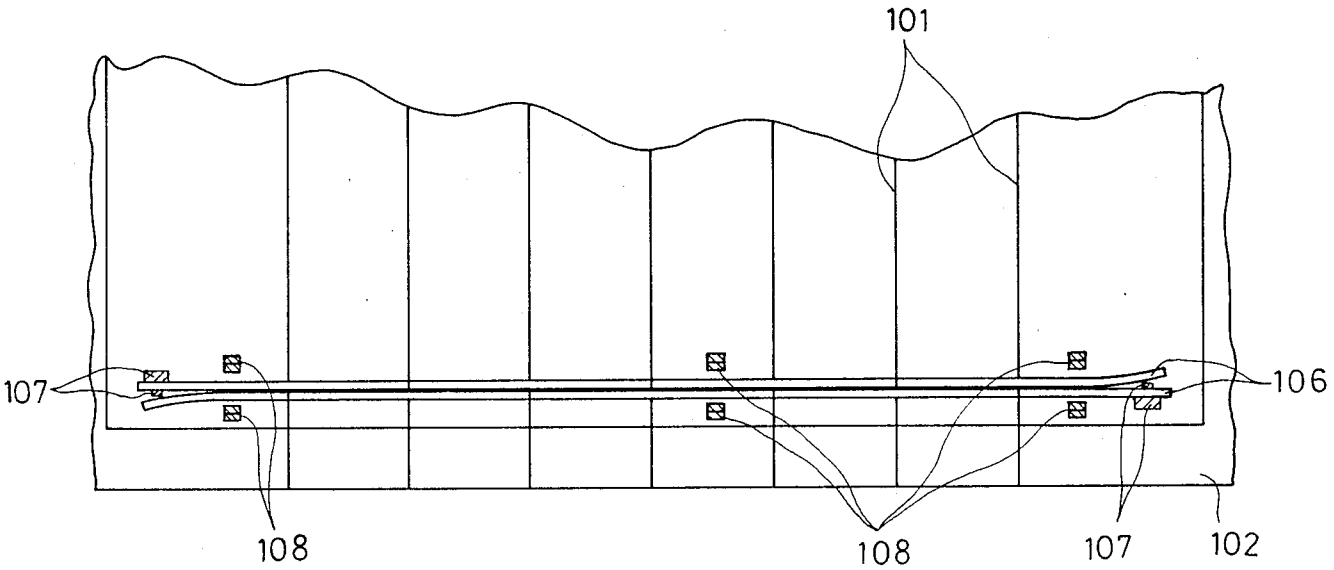
FIG. 4 shows a plan view of the vibration damping means of the embodiment shown in FIG. 3.
Figure 5:
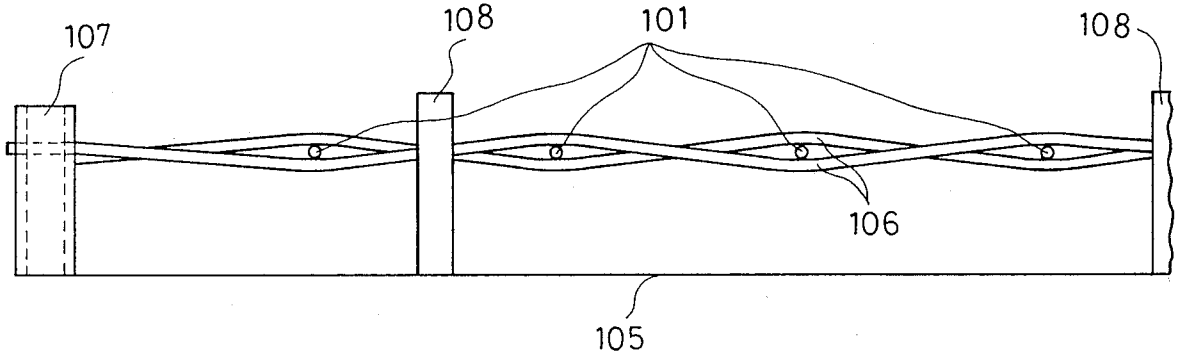
FIG. 5 shows a side view of the vibration damping means of the embodiment shown in FIG. 3.

FIGS. 4 and 5 show the plan view and the side view for showing the construction for supporting the damping strings. Numeral 108 designates a retaining member which prevents movement in the vertical direction to the stretching direction, thereby retaining the damping strings 106a, 106b in a predetermined position.

While in the above embodiment the damping strings are stretched along the plural line cathodes, in another embodiment the damping strings are respectively stretched to respective line cathodes. It is desirable that the damping strings do not defract the parallelism of the line cathode. The damping strings can be made of inorganic material such as glass, quartz fiber, metallic wire with insulation means and others, organic material such as plastic and others, or composite materials thereof. The damping strings can have a round shape or some other shape in section.

It is also desirable that the damping strings are provided outside the displaying area which is defined as the area passing the electron beams for displaying the image.

We claim:

1. An image display apparatus comprising:

line cathodes for emitting electron beams;

electron beam controlling means for controlling convergence, deflection and intensity of said electron beams;

a phosphor screen having a phosphor layer which emits light at impingement by said electron beams;

supporting means for supporting and stretching said line cathodes;

vibration damping means having at least a damping string which is provided across and lightly touching said line cathodes; and a vacuum enclosure containing the above-mentioned components therein.

2. An image display apparatus in accordance with claim 1, wherein said vibration damping means comprises one or more damping strings which are knitted together with said line cathodes.

3. An image display apparatus in accordance with claim 1 or 2, wherein said damping strings are provided outside the displaying area.

4. An image display apparatus comprising:

line cathodes for emitting electron beams;

electron beam controlling means for controlling convergence, deflection and intensity of said electron beams;

a phosphor screen having a phosphor layer which emits light at impingement by said electron beams;

supporting means for supporting and stretching said line cathodes;

vibration damping means having at least one damping string which is provided across and lightly touching said line cathodes;

a retention member for retaining said vibration damping means in a predetermined position by preventing movement of said at least one damping string in a direction perpendicular to the stretching direction of said at least one damping string;

a fixing member for fixing one end of said vibration damping means; and a vacuum enclosure containing the above-mentioned components therein.

5. An image display apparatus in accordance with claim 4, wherein said vibration damping means comprises one or more damping strings which are knitted together with said line cathodes.

6. An image display apparatus in accordance with claim 4 or 5, wherein said damping strings are provided outside the displaying area.

* * * * *